US006363874B1

(12) United States Patent
Griffith, Sr.

(10) Patent No.: US 6,363,874 B1
(45) Date of Patent: Apr. 2, 2002

(54) ROTATIONAL ELECTRIC BOW THRUSTER FOR A MARINE PROPULSION SYSTEM

(75) Inventor: Thomas E. Griffith, Sr., Florence, MS (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/540,079

(22) Filed: Mar. 31, 2000

(51) Int. Cl.[7] ..... B63H 25/46
(52) U.S. Cl. ..... 114/151; 440/40
(58) Field of Search ..... 60/222; 114/151; 440/40, 42

(56) References Cited

U.S. PATENT DOCUMENTS 2,214,656 A * 9/1940 Briggs ..... 244/52
3,517,633 A * 6/1970 Wanzer ..... 114/151
3,763,819 A * 10/1973 Mays ..... 116/17
3,835,806 A * 9/1974 Rice ..... 440/40
4,030,442 A * 6/1977 White ..... 440/41
4,074,652 A * 2/1978 Jackson ..... 440/58
4,175,511 A * 11/1979 Krautkremer ..... 440/54
4,278,431 A * 7/1981 Krautkremer et al. ..... 440/42
5,131,875 A * 7/1992 Lee ..... 440/7
5,171,173 A * 12/1992 Henderson et al. ..... 440/7

* cited by examiner

*Primary Examiner*—Joseph Morano
*Assistant Examiner*—Andrew Wright
(74) *Attorney, Agent, or Firm*—Fletcher, Yoder & Van Someren

(57) ABSTRACT

The present invention provides a propulsion system for a watercraft. The system includes a rotatable body adapted for fixed external mounting on a hull forward a transverse centerline of the watercraft. A prop is coupled to, and rotatable with, the rotatable body. The prop is coupled to a power transmission drive train, which is, in turn, coupled to a drive motor. The rotatable body is further coupled to an angular drive configured for orienting the prop to produce a thrust in a desired direction during operation.

44 Claims, 5 Drawing Sheets

ROTATIONAL ELECTRIC BOW THRUSTER FOR A MARINE PROPULSION SYSTEM

BACKGROUND OF THE INVENTION

1. Field of the Invention

The present invention relates generally to electric propulsion units for recreational watercraft. More specifically, the present invention relates to propulsion units which mount in a forward area of the watercraft.

2. Description of the Related Art

Recreational watercraft are typically used for a variety of activities such as fishing, cruising, water skiing, kneeboarding, tubing and like sports. To move the watercraft across the water, an adequate amount of thrust is necessary depending on the particular activity. The thrust may be provided by various types of propulsion systems, both engine-driven and electric-motor driven. Electrical and mechanical propulsion systems generally include outboard and inboard engine driven propeller systems.

Internal combustion engine drives are generally disposed at the rear of a watercraft at a transom, either outboard or inboard. Outboard motors are typically secured to the transom of a boat, while inboard motors have a propeller extending through the transom from an internal combustion engine disposed within a housing of the hull. Both outboard and inboard motors are particularly useful for high-speed and highly responsive navigation of the watercraft. Drawbacks of such drives, however, include their noise levels, exhaust emissions, relative complexity, size and weight.

Electric propulsion systems for pleasure craft are typically referred to as trolling motors or electric outboards. These systems include an electric motor which can be rotated at various speeds to drive a prop. The prop produces a thrust which is directed by proper orientation of the propulsion unit. In conventional trolling motors, for example, a control head may be manually oriented to navigate the boat in a desired direction, or a remote control assembly may be provided for rotating a support tube which holds the propulsion unit submerged during use. While certain relatively minor differences may exist, the term electric outboard is typically employed for the conventional trolling motor design, but with a horsepower range elevated with respect to the conventional trolling motor, such as in excess of 1 horsepower.

While the conventional trolling motor provides quiet and reliable navigation, extremely useful for certain activities such as fishing, there is considerable room for improvement. For example, conventional trolling motors are typically after-market, add-on units designed for mounting on the deck of a watercraft. Such units are typically supported by a mounting structure, a wide range of which may be obtained commercially. These structures allow for relatively straightforward deployment of the motor to position the propulsion unit below the waterline alongside the watercraft, and retraction of the unit for stowage on the deck. The entire motor and mount, however, generally remain securely fixed to the deck, both during use and when stowed. The resulting structure is somewhat cumbersome and occupies useful space on the deck, limiting access to the water in the area of the motor mount. Moreover, while much energy and creativity have been invested in Eboat designs, the aesthetics of the hull may be somewhat impaired by the trolling motor and mount positioned on the deck, typically adjacent to the bow. Furthermore, conventional trolling motors only provide thrust at a point around the perimeter of a watercraft, thereby allowing external forces such as wind to force the watercraft out of alignment with the desired direction of movement across the water.

SUMMARY OF THE INVENTION

The present invention provides a propulsion system for a watercraft to address these drawbacks. The system includes a rotatable thrust assembly, which is adapted for mounting on a hull, such as forward a transverse centerline of the watercraft. The system includes a prop or props coupled to, and rotatable with, the rotatable assembly. The prop is further coupled to a power transmission drive train, which is then drivingly coupled to a drive motor. The rotatable assembly is also coupled to an angular drive configured for orienting the prop to produce a thrust in a desired direction during operation.

In accordance with other aspects of the present invention, a propulsion system for a watercraft includes a recessional housing configured for mounting on a hull forward a transverse centerline of the watercraft. The system also includes a rotatable body, which is mounted in the recessional housing. The system further includes a prop coupled to, and rotatable with, the rotatable body. The prop is further coupled to a power transmission drive train, which is then drivingly coupled to a drive motor. The rotatable body is also coupled to an angular drive configured for orienting the prop to produce a thrust in a desired direction during operation.

The present techniques also offer a watercraft that includes a hull having a recessional housing forward a transverse centerline of the watercraft. A rotatable body is fixedly mounted in the recessional housing. A prop is coupled to, and rotatable with, the rotatable body. The prop is further coupled to a power transmission drive train, which is then drivingly coupled to a drive motor. The rotatable body is also coupled to an angular drive configured for orienting the prop to produce a thrust in a desired direction during operation.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
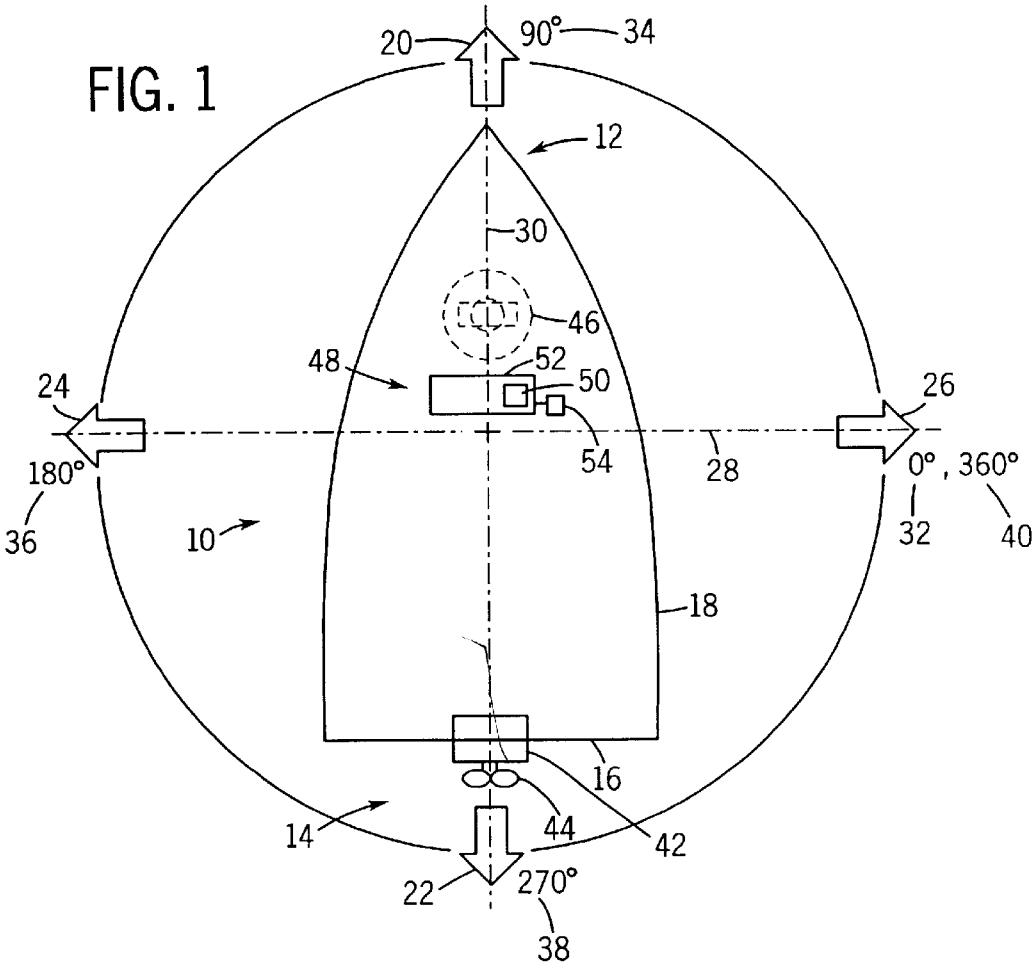
FIG. 1 is a top view of a watercraft illustrating an embodiment of the present invention disposed therein.

Turning now to the drawings and referring first to FIG. 1, the present invention is configured for mounting in a watercraft 10 having a bow 12, a stem 14, a transom 16 at the stem 14, a hull 18. For navigational reference, FIG. 1 indicates a forward 20, a reverse 22, a left 24, and a right 26 direction, and a transverse centerline 28, a longitudinal centerline 30, and a 0° angle 32, a 90° angle 34, a 180° angle 36, a 270° angle 38, and a 360° angle 40. The watercraft may also have a rear drive 42, mounted either inboard or outboard as illustrated in FIG. 1. The rear drive 42, which may be a conventional outboard motor, for example, has a prop 44 for displacing water to propel the watercraft 10. The invention provides a propulsion assembly 46 mounted to the hull 18, such as in a position forward of the transverse centerline 28, preferably along the longitudinal centerline 30. The propulsion assembly 46 is controlled by a control system 48, which may include instruments 50 disposed on a console 52, and a foot pedal 54 for hands-free control of the propulsion assembly 46. As will be appreciated by those skilled in the art, the foot pedal control input may be replaced or complemented by other input devices, including a joy stick, steering wheel, console switches, and so forth.

Figure 2:
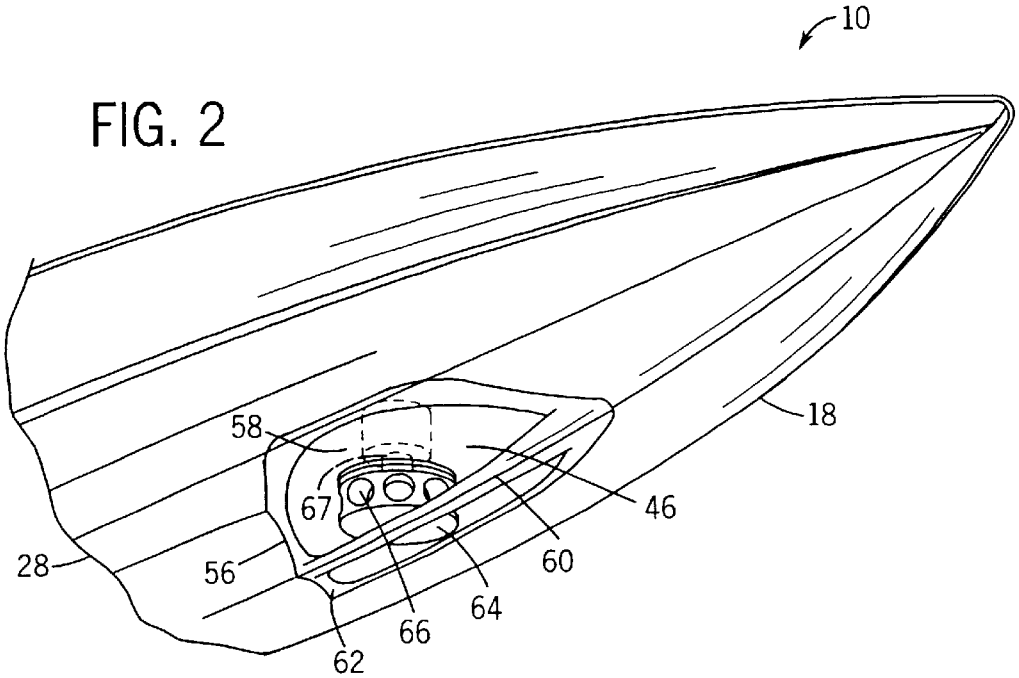
FIG. 2 bottom perspective view illustrating an embodiment of the invention having a propulsion assembly mounted in a recessional housing.

FIG. 2 illustrates a bottom perspective view of the watercraft 10 having the propulsion assembly 46 mounted in a recessional housing 56, which is sealingly coupled to the hull 18, typically forward of the transverse centerline 28. The recessional housing 56 extends inwardly into the hull 18, preferably to a mounting area 58 configured for the propulsion assembly 46. A support 60 extends across the recessional housing 56 and over the propulsion assembly 46 in the illustrated embodiment. When provided, the support 60 is preferably streamlined with the hull 18. However, the recessional housing 56 may be designed without a support 60, or with an alternate orientation or design. Alternatively, the recessional housing 56 may be eliminated if the propulsion assembly 46 is properly supported and water drag is either insignificant or addressed by other means, such as a fin.

The recessional housing 56 may be manufactured separately from, or together with, the hull 18. The recessional housing 56 is preferably manufactured from fiberglass, but may be made from metal such as aluminum, or a variety of other materials, such as moldable plastics, depending on the application. If manufactured separately from the hull 18, the recessional housing 56 preferably has a reinforced area 62 extending around the recessional housing 56 to ensure a strong watertight mounting to the hull 18. Furthermore, the recessional housing 56 preferably mounts along the longitudinal centerline 30 (see FIG. 1) to provide a more symmetric and balanced control of the watercraft 10. However, if a plurality of propulsion assemblies 46 are mounted to the watercraft 10, or if other considerations require, the propulsion assembly 46 may be mounted at other locations on the hull 18.

The propulsion assembly 46 preferably includes a stationary housing 64 having a plurality of openings 66 disposed around the stationary housing 64. The stationary housing 64 is coupled to the mounting area 58 by a support 67, which supports the stationary housing 64 offset or spaced slightly from the mounting area 58.

Figure 3:
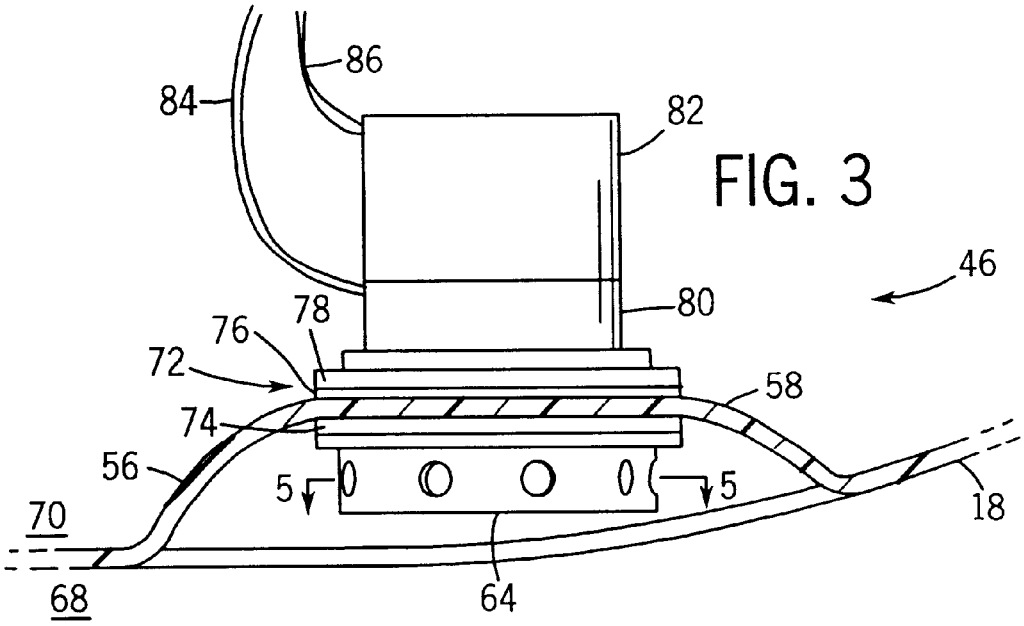
FIG. 3 illustrates a side view of the propulsion assembly disposed at a mounting area of the recessional housing.

FIG. 3 illustrates a side view of an embodiment of the propulsion assembly 46 disposed at the mounting area 58, wherein the hull 18 and the recessional housing 56 are illustrated as cross-sections along the longitudinal centerline 30 of the watercraft 10 (see FIG. 1). As illustrated, the preferred embodiment of the present invention has the propulsion assembly 46 mounted symmetrically about the mounting area 58. A part of the propulsion assembly 46 is mounted outboard, as indicated by reference numeral 68, while part of the propulsion assembly 46 is mounted inboard, as indicated at numeral 70. The stationary housing 64 is preferably sealingly fixed to the mounting area 58. 1n this embodiment, the propulsion assembly 46 includes a support and seal assembly 72, which may include a first plate 74, a seal 76 and a second plate 78. The first plate 74 is disposed outboard 68 between the stationary housing 64 and the mounting area 58. The seal 76 is preferably disposed inboard 70 at the mounting area 58. The second plate 78 is disposed adjacent the seal 76. In the embodiment of FIG. 3, the propulsion assembly 46 further includes an angular drive motor 80 and a primary drive motor 82, which are mounted inboard opposite to the stationary housing 64. The primary drive motor 82 and the angular drive motor 80 are preferably separate electric motors capable of forward or reverse operation. However, other power sources are possible, and reverse operation may be achieved through a separate gearbox. Wiring assemblies 84 and 86 are coupled to the angular drive motor 80 and the primary drive motor 82, respectively. The wiring assemblies 84 and 86 are further coupled to the control system 48 (see FIG. 1), which provides power to the propulsion assembly 46 and user control of its operation.

Figure 4:
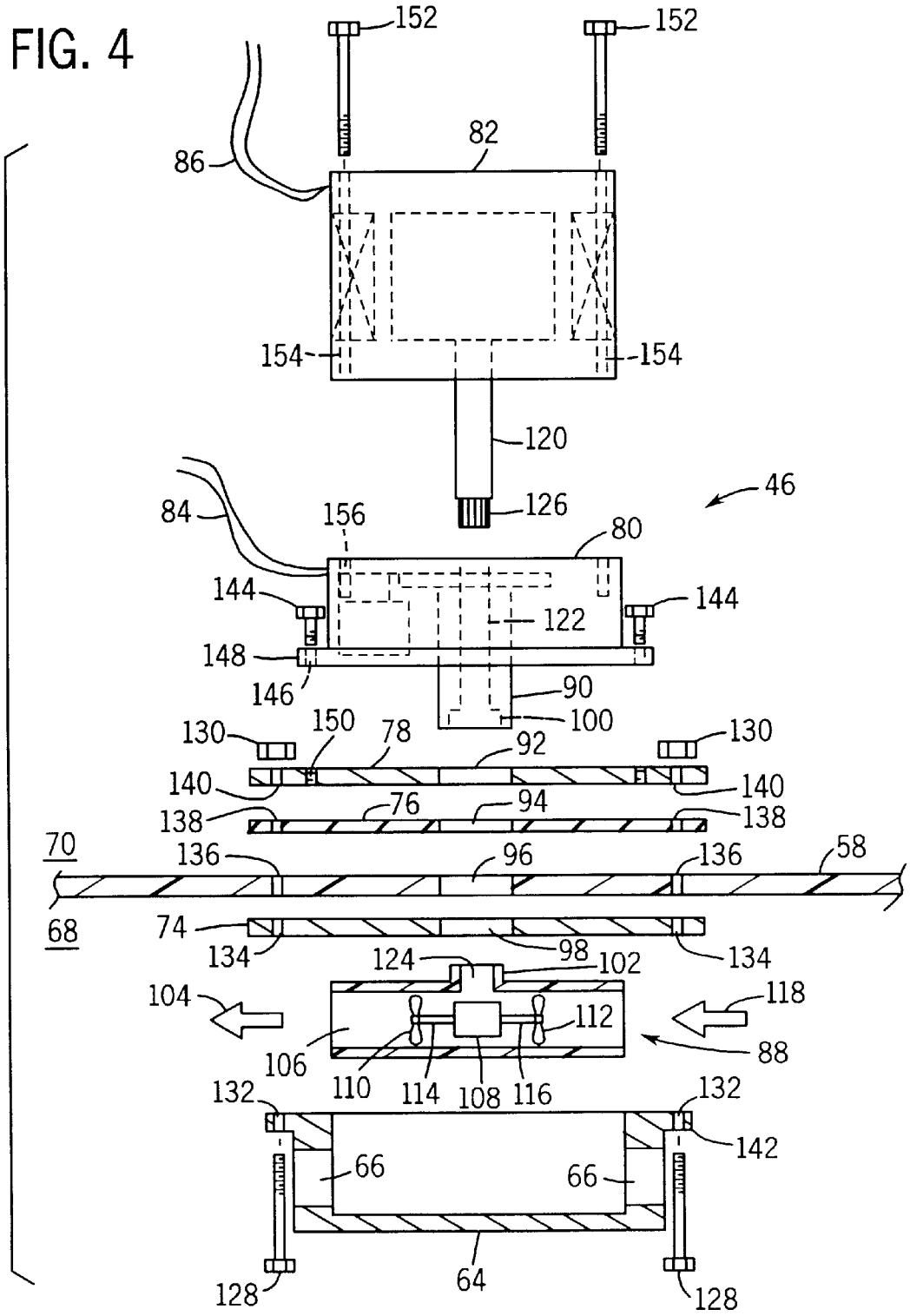
FIG. 4 illustrates an exploded view of the propulsion assembly, exploded about the mounting area.

FIG. 4 illustrates an exploded view of the propulsion assembly 46. As illustrated, the propulsion assembly 46 has a rotatable thruster assembly 88, which rotatably fits into the stationary housing 64. In operation, the rotatable thruster assembly 88 is rotated by a hollow drive shaft 90 extending from the angular drive motor 80. The hollow drive shaft 90 rotatably fits through holes 92, 94, 96 and 98 of the second plate 78, the seal 76, the mounting area 58 and the first plate 74, respectively. The hollow drive shaft 90 has a female joint 100, which then fixedly couples to a male joint 102 of the rotatable thruster assembly 88. The rotatable thruster assembly 88 provides a thrust, as indicated by arrow 104, by propelling water through a thrust conduit 106. A gearbox 108 is centrally disposed within the thrust conduit 106, wherefrom props 110 and 112 are coupled to drive shafts 114 and 116, respectively, on opposite sides of the gearbox 108. The props 110 and 112 are axially aligned in this embodiment, but may be disposed out of alignment, depending on the particular configuration of the thrust conduit 106. The props 110 and 112 also may be disposed on the same side of the gearbox 108 (i.e., coupled to the drive shaft 114), or one of the props 110 and 112 may be eliminated entirely.

The thrust conduit 106, as illustrated, is substantially straight and cylindrical in shape. However, the thrust conduit 106 may bend to an oblique angle depending on the desired angle of entry and exit of water. The thrust conduit 106 may also have a non-uniform cross-section for improved flow, or to accommodate the configuration of the internal components (i.e., the props 110 and 112 and the gearbox 108).

In operation (FIGS. 6–8), the props 110 and 112 displace incoming water, as indicated by arrow 118, through the thrust conduit 106. The props 110 and 112 are driven by the primary drive motor 82, which has a drive shaft 120 drivingly coupled to the gearbox 108. The drive shaft 120 is rotatably disposed through a support conduit 122 of the angular drive motor 80, through holes 92, 94, 96 and 98, and through a support conduit 124 of the rotatable thruster assembly 88. In this embodiment, the drive shaft 120 is rigid. Alternatively, an embodiment of the drive shaft 120 may include a flexible shaft assembly. A geared end 126 of the drive shaft 120 engages the gearbox 108. The gearbox 108 transmits torque from the drive shaft 120 to the props 110 and 112. Where desired, the conduit may be positioned in a cross-direction (generally parallel to the craft transverse axis) for stowage, thereby reducing water intake and drag. Moreover, one or more covers (not shown) may be provided for capping one or more of the water passageways in this stowed position.

The stationary housing 64 is secured to the mounting area 58 via fasteners (see FIG. 4), such as bolts 128 and nuts 130. The bolts 128 are disposed through holes 132, 134, 136, 138 and 140, which extend through a flange 142 of the stationary housing 64, the first plate 74, the mounting area 58, the seal 76, and the second plate 78, respectively. The bolts 128 are then secured by the nuts 130. The angular drive motor 80 is secured to second plate 78 with bolts 144, which extend through holes 146 on a flange 148 of the angular drive motor 80. The bolts 144 then screw into threads 150 on the second plate 78, for example. The primary drive motor 82 is coupled to the angular drive motor 80 via bolts 152, which extend through holes 154 and engage threads 156 on the angular drive motor 80.

Figure 5:
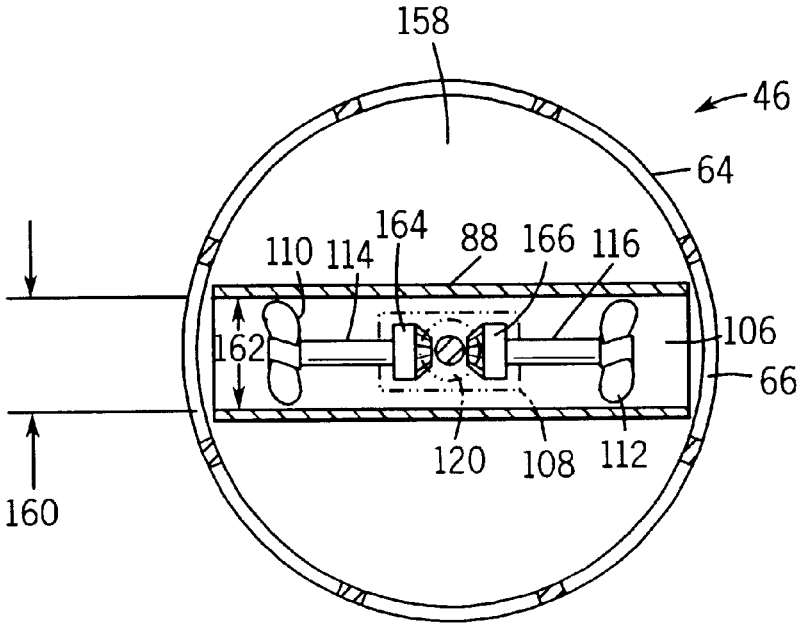
FIG. 5 is a cross-sectional top view of an embodiment of the invention, illustrating a rotatable thruster assembly disposed in a stationary housing.

FIG. 5 illustrates a cross-sectional top view of the rotatable thruster assembly 88 disposed in the stationary housing 64. In this exemplary embodiment, the stationary housing 64 has a cylindrical cavity 158, and the openings 66 extend through the stationary housing 64 in pairs diametrically opposite from one another. The openings 66 have cross-sections 160 substantially equivalent to a cross-section 162 of the thrust conduit 106. The thrust conduit 106 rotates within the cylindrical cavity 158, as the primary drive motor 82 turns the drive shaft 120. As illustrated, the drive shaft 120 engages the gearbox 108 at bevel gears 164 and 166, which in turn rotate the props 110 and 112 coupled to drive shafts 114 and 116, respectively.

Figure 6:
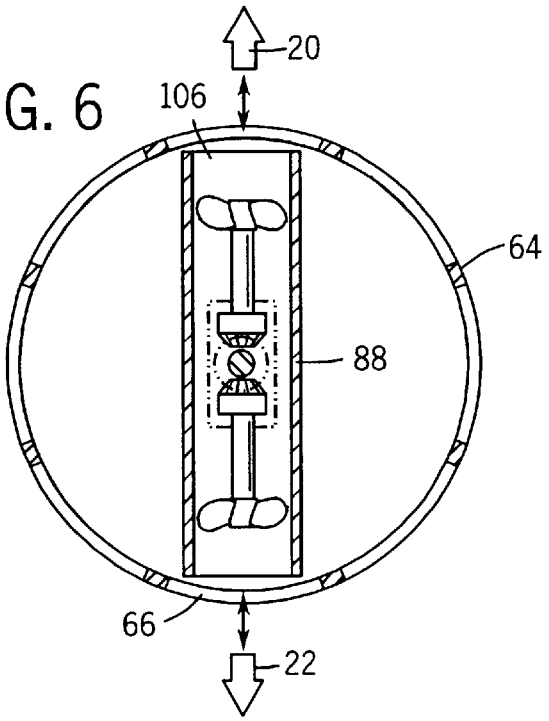
FIG. 6 illustrates a cross-sectional top view of the stationary housing, and the rotatable thruster assembly oriented at 90° to produce a forward or reverse thrust.
Figure 7:
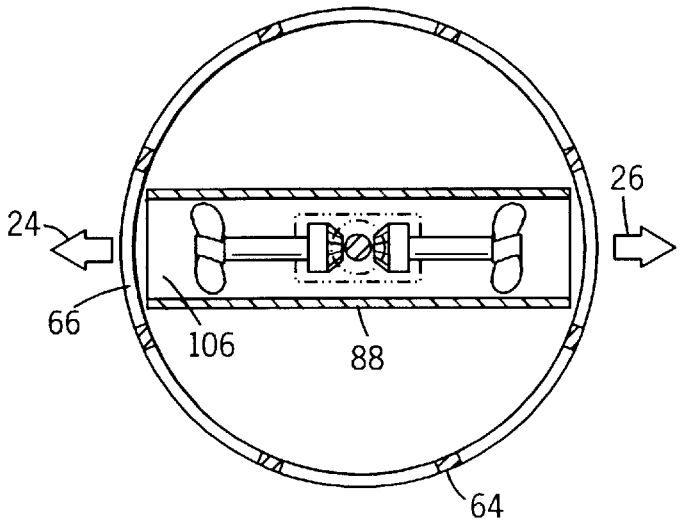
FIG. 7 illustrates a cross-sectional top view of the stationary housing, and the rotatable thruster assembly oriented to produce a left or right thrust.
Figure 8:
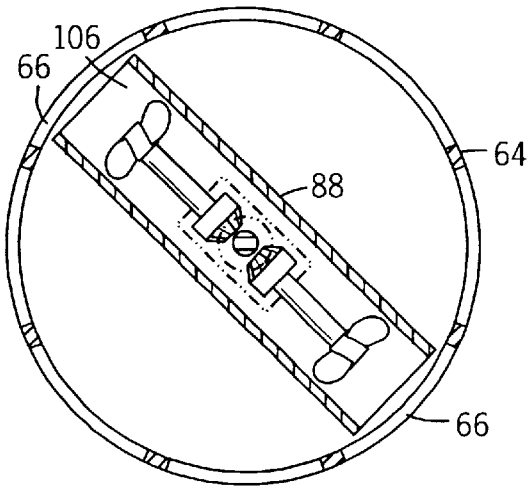
FIG. 8 illustrates cross-sectional top view of the stationary housing, and the rotatable thruster assembly oriented to produce thrust at an angle of 45°.

FIGS. 6–8 illustrate cross-sectional top views of the rotatable thruster assembly 88 disposed in the stationary housing 64, wherein the rotatable thruster assembly 88 is oriented at 90° (34), 180° (36), and 45°, respectively. FIG. 6 illustrates the rotatable thruster assembly 88 oriented to produce thrust in the forward 20 or the reverse 22 direction. To change the direction of the thrust, the thrust conduit 106 aligns with the openings 66 as disposed on the stationary housing 64. FIG. 7 illustrates the thrust conduit 106 oriented to produce thrust to the left 24 or to the right 26. In FIG. 8, the thrust conduit 106 is oriented to produce thrust at an angle such as 45°.

Figure 9:
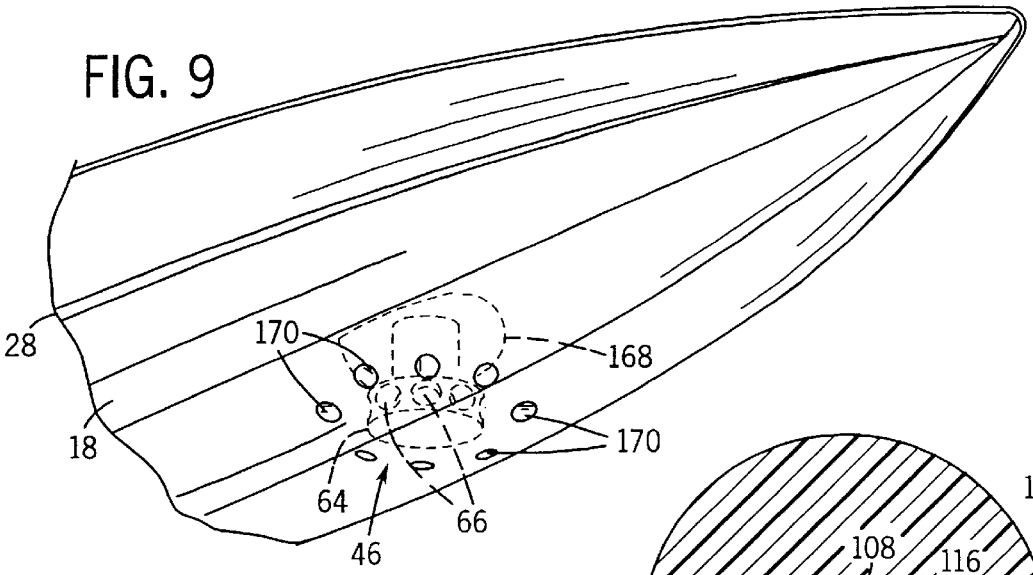
FIG. 9 illustrates a bottom perspective view of an alternate embodiment of the present invention, wherein the recessional housing is closed except for openings aligned with openings in the propulsion assembly.

FIG. 9 illustrates a bottom perspective view of an alternate embodiment of the propulsion system, wherein a recessional housing 168 is disposed in the hull 18 forward the transverse centerline 28 along the longitudinal centerline 30 (see FIG. 1). The recessional housing 168, in contrast to the recessional housing 56, is completely closed except for a plurality of openings 170 aligned with the openings 66 on the stationary housing 64. This provides an alternate way of protecting the propulsion assembly 46 and streamlining the hull 18.

Figure 10:
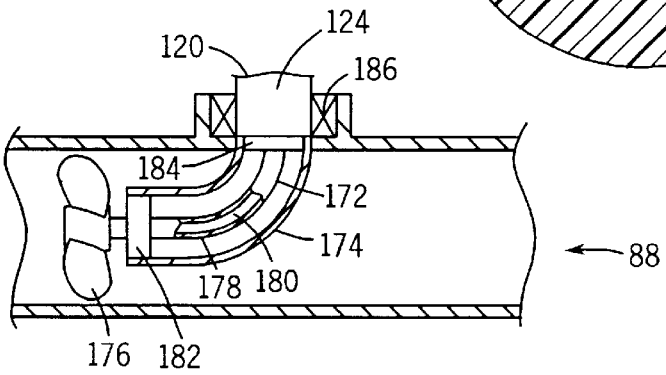
FIG. 10 illustrates a cross-sectional view of an alternate embodiment of the present invention, wherein the rotatable thruster assembly has a flexible shaft assembly rather than the gearbox.

FIG. 10 illustrates a cross-sectional view of an alternate embodiment of the present invention, wherein the rotatable thruster assembly 88 has a flexible shaft assembly 172 rather than the gearbox 108. The flexible shaft assembly 172 is disposed in a support tube 174, which is sealingly fixed to the support conduit 124 and gradually bends 90° to a prop 176. The flexible shaft assembly 172 is typically a premanufactured assembly having a stationary outer tube or sheath 178 and an inner shaft 180. The support tube 174 also has sealed bearings 182 and 184 for the inner shaft 180. The support conduit 124 has a drive bearing 186, which is configured for the drive shaft 120 extending from the primary drive motor 82.

Figure 12:
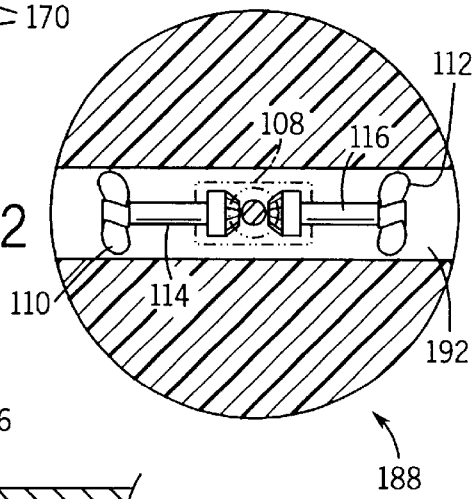
FIG. 12 illustrates a cross-sectional top view of the disc-shaped rotational thruster assembly.
Figure 11:
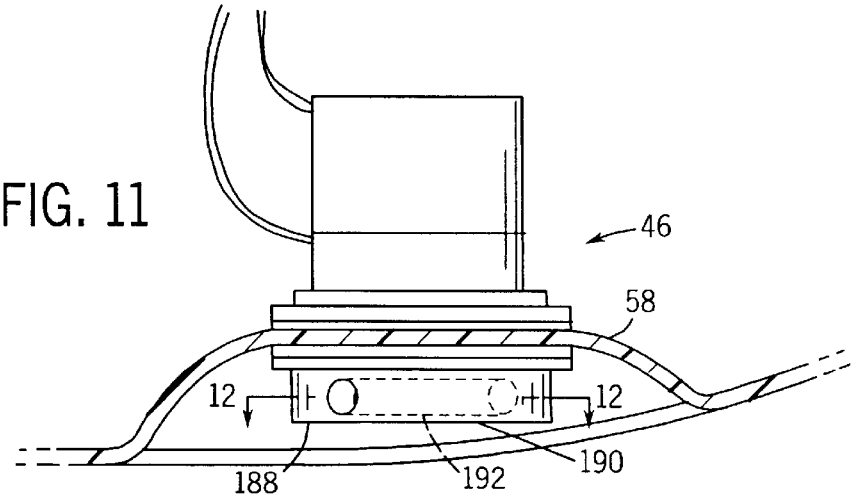
FIG. 11 illustrates a side view of an alternate embodiment of the present invention, wherein the rotatable thruster assembly is substantially disc-shaped and has a cylindrical conduit disposed therein.

FIGS. 11–12 illustrate an alternate embodiment, wherein a rotatable thruster assembly 188 replaces the rotatable thruster assembly 88. FIG. 11 illustrates a side view of the propulsion assembly 46 disposed at the mounting area 58. In this alternate embodiment, the rotatable thruster assembly 188 has a disc-shaped body 190 with a thrust conduit 192. Also, the rotatable thruster assembly 190 is preferably not fixed to the mounting area 58, and there is no stationary housing 64. FIG. 12 illustrates section 12—12 of FIG. 11, which is a cross-sectional top view of the rotational thruster assembly 188. As illustrated, the rotational thruster assembly 188 has essentially the same internal components as the rotational thruster assembly 88. The gearbox 108 is centrally disposed within the thrust conduit 192, and the props 110 and 112 are coupled to the drive shafts 114 and 116, respectively, on opposite sides of the gearbox 108. Although the stationary housing 64 is not required in this alternate embodiment, the stationary housing 64 may be desirable to improve stability and/or sealing to the mounting area 58. Again, as noted above, the assembly may be rotated to a "no flow" or transverse stowed position to reduce drag.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A propulsion system for a watercraft having a hull, the system comprising:

a stationary housing disposed external to the hull, the stationary housing having a plurality of openings therethrough;

a rotatable body disposed within the stationary housing;

a prop coupled to the rotatable body and rotatable therewith;

a power transmission drive train coupled to the prop;

a drive motor coupled to the power transmission drive train; and an angular drive coupled to the rotatable body configured for orienting the prop to produce a thrust in a desired direction during operation by drawing in fluid through a first opening in the stationary housing and discharging the fluid through a second opening in the stationary housing.

2. The propulsion system of claim 1, wherein the rotatable body further comprises a primary conduit configured to house the prop, the primary conduit having an entrance and an exit.

3. The propulsion system of claim 2, wherein the primary conduit comprises a straight cylinder, and the entrance and the exit are disposed at ends thereof opposite one another.

4. The propulsion system of claim 2, wherein the primary conduit comprises a cross-section of uniform area along the primary conduit.

5. The propulsion system of claim 2, wherein the stationary housing comprises a plurality of pairs of openings disposed circumferentially around the stationary housing and configured for alignment with the entrance and the exit of the primary conduit as the rotatable body is rotated, through which the prop is configured to displace water during operation; and a control system coupled to the drive motor and the angular drive, wherein the drive motor is electric and the angular drive has an electric motor.

6. The propulsion system of claim 1, wherein the rotatable body is substantially disk-shaped.

7. The propulsion system of claim 1, wherein the plurality of openings extend between an external surface and an inner cavity in which the prop is disposed.

8. The propulsion system of claim 1, comprising a plurality of props drivingly coupled to the drive motor.

9. The propulsion system of claim 8, wherein the plurality of props are axially aligned with one another.

10. The propulsion system of claim 1, further comprising a gear box coupling the prop to the power transmission drive train.

11. The propulsion system of claim 10, wherein the prop is coupled to a shaft extending from the gear box.

12. The propulsion system of claim 1, wherein the power transmission drive train comprises a flexible shaft.

13. The propulsion system of claim 1, wherein the power transmission drive train is adapted for sealingly extending through the hull.

14. The propulsion system of claim 1, wherein the drive motor is electric.

15. The propulsion system of claim 1, wherein the drive motor is configured for mounting inboard of the hull.

16. The propulsion system of claim 1, wherein the drive motor is reversible.

17. The propulsion system of claim 1, wherein the angular drive is configured to rotate the rotatable body to an angle within an operable range relative to a transverse centerline.

18. The propulsion system of claim 17, wherein the operable range includes angles from 0° to 360° with respect to the taansverse centerline.

19. The propulsion system of claim 17, wherein the operable range includes angles from 0° to 180° with respect to the transverse centerline.

20. The propulsion system of claim 1, further comprising at least one steering member adapted to couple the angular drive to the rotatable body.

21. The propulsion system of claim 20, wherein the steering member comprises a hollow shaft adapted for disposal about the power transmission drive train.

22. The propulsion system of claim 1, further comprising a control system coupled to the drive motor and the angular drive.

23. The propulsion system of claim 22, further comprising a foot control coupled to the control system.

24. A propulsion system for a watercraft, the system comprising:

a recessional housing configured for fixed external mounting on a hull forward a transverse centerline of the watercraft;

a rotatable body rotatably mounted in the recessional housing, the rotatable body comprising a cylinder having an entrance and an exit disposed at opposite ends of the cylinder;

a prop housed within the cylinder, coupled to the rotatable body and rotatable therewith;

a power transmission drive train coupled to the prop;

a drive motor coupled to the power transmission drive train;

an angular drive coupled to the rotatable body configured for orienting the prop to produce a thrust in a desired direction during operation; and a stationary housing configured for fixed mounting in the recessional housing, the stationary housing having at least the prop disposed therein, and the stationary housing having at least one opening configured to permit the prop to displace water during operation.

25. The propulsion system of claim 24, wherein the rotatable body is substantially disk-shaped.

26. The propulsion system of claim 24, comprising a plurality of openings extending between an external surface and an inner cavity in which the prop is disposed.

27. The propulsion system of claim 24, comprising a plurality of props drivingly coupled to the drive motor.

28. The propulsion system of claim 24, wherein the power transmission drive train comprises a flexible shaft.

29. The propulsion system of claim 24, wherein the drive motor is electric.

30. The propulsion system of claim 24, wherein the angular drive is configured to rotate the rotatable body to an angle within an operable range relative to the transverse centerline.

31. The propulsion system of claim 30, herein the operable range includes angles from 0° to 180° with respect to the transverse centerline.

32. The propulsion system of claim 24, further comprising a hollow steering member disposed about the power transmission drive train, the hollow steering member coupling the angular drive to the rotatable body.

33. The propulsion system of claim 24, further comprising a control system coupled to the drive motor and the angular drive.

34. The propulsion system of claim 33, further comprising a foot control coupled to the control system.

35. A watercraft comprising:

a hull having a recessional housing forward a transverse centerline of the watercraft;

a stationary housing external to the hull and disposed within the recessional housing, the stationary housing having a plurality of openings for fluid flow therethrough;

a rotatable body rotatably mounted within the stationary housing and the recessional housing;

a prop coupled to the rotatable body and rotatable therewith;

a power transmission drive train coupled to the prop;

a drive motor coupled to the power transmission drive train; and an angular drive coupled to the rotatable body configured for orienting the prop to produce a thrust in a desired direction during operation.

36. The watercraft of claim 35, wherein the rotatable body further comprises a primary conduit configured to house the prop, the primary conduit having an entrance and an exit.

37. The watercraft of claim 35, wherein the rotatable body is substantially disk-shaped.

38. The watercraft of claim 35, comprising a plurality of openings extending between an external surface and an inner cavity in which the prop is disposed.

39. The watercraft of claim 35, wherein the power transmission drive train comprises a flexible shaft.

40. The watercraft of claim 35, wherein the drive motor is electric.

41. The watercraft of claim 35, wherein the angular drive is configured to rotate the rotatable body to an angle within an operable range relative to the transverse centerline.

42. The watercraft of claim 35, further comprising a hollow steering member disposed about the power transmission drive train, the hollow steering member coupling the angular drive to the rotatable body.

43. The watercraft of claim 35, further comprising a control system coupled to the drive motor and the angular drive.

44. The watercraft of claim 43, further comprising a foot control coupled to the control system.

* * * * *